United States Patent [19]

Smith

[11] 4,236,556

[45] Dec. 2, 1980

[54] WOOD SPLITTER ATTACHMENT

[76] Inventor: Robin C. Smith, P.O. Box 1154, Truckee, Calif. 95734

[21] Appl. No.: 38,776

[22] Filed: May 14, 1979

[51] Int. Cl.[3] ..... B27L 7/00

[52] U.S. Cl. ..... 144/193 A; 180/53 R

[58] Field of Search ..... 180/53 R, 53 FE, 53 C, 180/53 D; 144/2 N, 3 K, 193 R, 193 A

[56] References Cited

U.S. PATENT DOCUMENTS 3,780,779 12/1973 Guy ..... 144/193 A

*Primary Examiner*—W. Donald Bray

*Attorney, Agent, or Firm*—Lothrop & West

[57] ABSTRACT

A wood splitting attachment is provided for use with one of the stabilizer legs and attendant hydraulic ram of a conventional backhoe or the like. After separation of the ram from the stabilizer by removing the connecting pivot pin, a push plate is pivotally attached to the powered rod of the hydraulic ram and a support framework is pivotally attached to the stabilizer. The support framework includes side wings to cradle the wood and a wedge-shaped anvil is positioned on the after portion of the framework so that a piece of wood placed upon the framework is split by the wedge as the push plate urges the wood against the anvil. By disconnecting the push plate from the ram and the framework from the stabilizer, the ram and stabilizer can be reconnected to return the backhoe to customary use.

8 Claims, 4 Drawing Figures

WOOD SPLITTER ATTACHMENT

BACKGROUND OF THE INVENTION

Powered log splitters, especially those using hydraulically actuated apparatus are well known in the art. First attempts at such devices required an independent hydraulic system, an engine to power the system, and a framework to support the mechanism and wood to be split. While this approach provided a usable splitter, it also proved expensive to construct and cumbersome to transport. More recently, log splitters have appeared which use the existing hydraulic system of a powdered vehicle. For instance, Worthington, U.S. Pat. No. 3,760,854, discloses a log splitter for use with vehicles such as conventional three-point hitch equipped vehicles, having hydraulic pressure systems. While this version eliminates the need for an independently powered hydraulic system, it still requires an independent hydraulic ram and a relatively time consuming hookup operation.

Another popular approach, illustrated in Guy, U.S. Pat. No. 3,780,779 and Krom, Jr., U.S. Pat. No. 4,073,325, is the adaptation of the hydraulic bucket actuator on a tractor or dip stick of a backhoe to power the splitting apparatus. By supplanting the tractor's bucket or dip stick with a wood splitting attachment and using the hydraulic ram to power the splitter, the necessity for an independent hydraulic ram is removed. Certain disadvantages, however, stem from the addition of an attachment to the dip stick or bucket support boom and the attendant hydraulic actuator.

The wood splitting apparatus, as shown in the Guy patent, rests upon the lip of the bucket. This support not only positions the splitting table at a fairly steep angle but also raises the wood splitting table to an excessive height, making loading both awkward and laborious. Additionally, the bucket gets in the way of both operator and the split, falling wood.

Another distinct disadvantage is inherent in the hydraulic bucket actuator adaptation. The wood splitting operation cannot be readily seen by the operator of the tractor owing to the physical separation between the splitter and the operator. Inability to see clearly the operation of the splitting ram increases the possibility of injury to the loading person.

The present design overcomes the difficulties presented by the previously discussed art. The invention discloses an attachment which quickly modifies the stabilizer leg of a backhoe or the like into a safe, convenient and efficient wood splitter.

SUMMARY OF THE INVENTION

The invention relates generally to wood splitting attachments for apparatus equipped with hydraulically powered systems.

Many types of earth moving and earth digging and lifting machines include a pair of hydraulically actuated stabilizer legs. These legs are normally used to level and steady the machine during its designated operation. The adaptation of one or both of these stabilizer legs for wood splitting has immediate advantages over approaches disclosed in the prior art. The wood can be loaded easily upon the relatively low, stable, splitting table, and the machine operator has an excellent view of the splitting apparatus in operating mode.

In the present invention, three simple elements comprise a system easily adaptable to virtually any stabilizer leg and hydraulic actuator. With the foot or support pad of the stabilizer arm resting on the ground, the pivot pin interconnecting the plunger, or piston rod, of the hydraulic ram and the stabilizer arm is removed.

The forward end of an elongated support framework is pivotally attached to the stabilizer arm using the same pivot pin and hole through which the ram plunger had previously been attached. The framework extends rearwardly from and in the same vertical plane as the stabilizer arm. A wedge-shaped anvil is positioned on the upper surface at the after end of the framework and the wedge tip is directed toward the forward end of the framework. Diverging flanges mounted on opposing upper edges of said framework and extending outwardly and upwardly act like a cradle to support and confine the wood from moving laterally during splitting. A pedestal positioned under the after end maintains the framework in a plane generally parallel to the ground.

In order to support and maintain the hydraulic ram in proper orientation and attitude, a hydraulic ram support is interposed between the hydraulic ram and the stabilizer arm. The upper end of the support is designed to conform to the shape of the generally cylindrical hydraulic ram and the lower end of the support is shaped to fit the angular beam of the stabilizer arm. Owing to this design, the support can be quickly slipped into position on the stabilizer at any desired location and then held securely by the weight of the overlying ram cylinder.

The hydraulically actuated piston rod extending outwardly from the ram pivotally connects through a clevis to a push plate. A limit stop bar is interposed between the clevis plates at a location such that interference between the limit stop bar and the bottom of the rod prevents the push plate from tilting downwardly past a predetermined position. Throughout its limited but adequate extent of rotation, the push plate is capable of engaging the forward end of a piece of wood placed upon the support framework. As the rod is urged outwardly, the push plate inclines to conform with the slope of the forward end of the wood, urging the piece against the wedge portion of the splitting anvil. Following splitting, the push plate and piston rod are retracted to allow a new piece of wood to be loaded.

DETAILED DESCRIPTION OF PREFERRED EMBODIMENT

Figure 1:
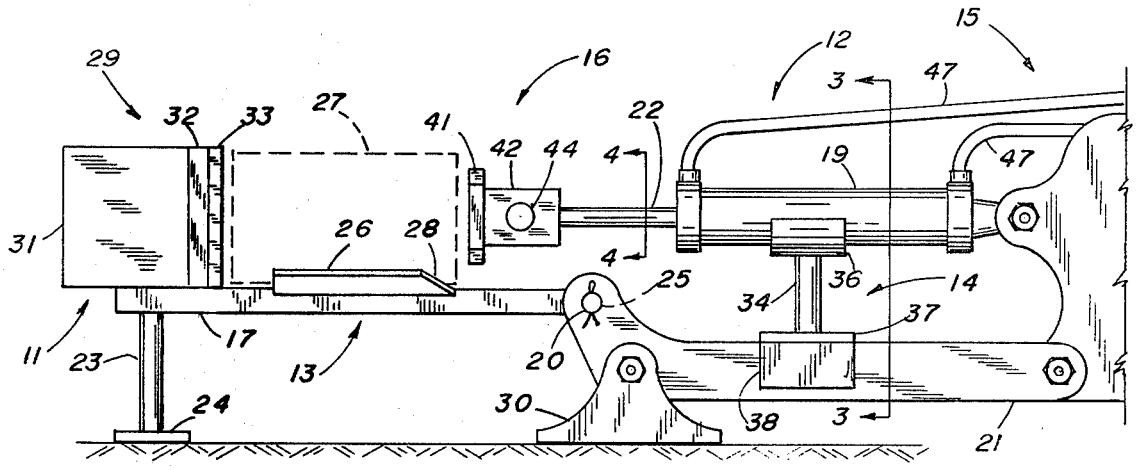
FIG. 1 is a side elevational view of the attachment connected to the hydraulic ram and stabilizer leg of a conventional backhoe, a piece of wood preparatory to being split being shown in broken line.
Figure 2:
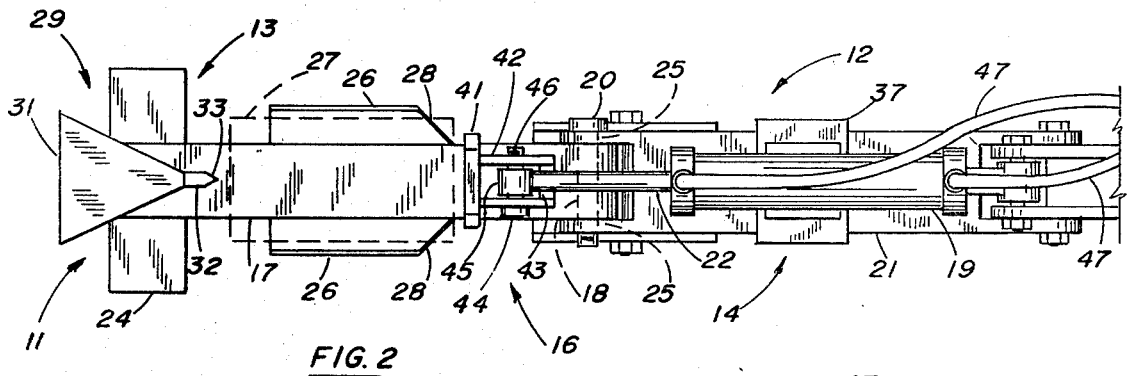
FIG. 2 is a top plan view.

With particular reference to FIGS. 1 and 2, the splitting attachment of the invention, generally designated by the reference numeral 11, is interconnected to the stabilizer leg mechanism, generally designated 12, of an apparatus, such as a backhoe 15, or the like. The splitting attachment 11 comprises an elongated main support framework 13, a hydraulic ram support 14, and push plate assembly 16.

The main support framework 13 provides support for and proper alignment of the wood to be split relative to the ram travel. The framework 13 includes an elongated horizontal beam 17 provided with an aperture 18 at its forward end to receive pin 20. The pin 20 can be the same pin that normally connects the piston rod 22 to the stabilizer leg 21 of the stabilizer structure 12, the stabilizer leg including a pair of registering openings 25 to receive the pin connecting the leg to the piston rod.

The stabilizer leg mechanism 12 includes not only a hydraulic ram 19 and stabilizer leg 21 but also a pivoted earth engaging foot pad 30.

Initiating the attachment hookup, the pin 20 is removed, permitting the piston rod 22 to be lifted upwardly, free from the stabilizer leg 21. The horizontal beam 17 is then interconnected with the stabilizer leg 21 as the pin 20 is inserted through aperture 18.

A pedestal 23 positioned under the after portion of said support framework 13 maintains the framework 13 in a plane generally parallel to that of the supporting terrain. Rectangular ground plate 24 is centered under the pedestal 23 and provides a stable base for supporting said framework 13 during active operation of the wood splitter.

A pair of rearwardly diverging flanges 26 is mounted upon opposing upper edges of the horizontal member 17, the flanges extending upwardly and laterally outwardly and being generally centered upon the longitudinal dimension of the horizontal beam 17. The flanges 26 and the upper surface of the beam 17 comprise a cradle-like support for the piece of wood 27 to be split, as shown in broken line. The forward edges 28 of the flanges 26 are forwardly converged to ensure that the push plate assembly 16 cannot impinge thereon during the splitting operation.

A splitting anvil 29 is positioned atop the after portion of the horizontal beam 17, the anvil 29 comprising a wedge-shaped main body 31 and a forwardly projecting splitting edge 32. The splitting edge 32 includes a tapered knife edge 33. The width of the anvil 29 progresses from a forwardly projecting sharp edge, through an intermediate breadth defined by the transverse dimension between the side walls of the splitting edge 32, to the rearwardly diverging portion of the wedge-shaped main body 31.

The inclusion of the splitting edge 32 and the knife edge 33 upon the forwardmost portion of the main body 31 has proved a significant improvement over a simple, sharpened, wedge-shaped splitting anvil. The sharpened splitting edge acts initially upon the subject piece of wood to separate wood fibers for a predetermined distance into the piece. Having established this limited penetration, the wood subsequently impinges upon the outwardly flaring walls of the wedge and final splitting is effected. By pre-splitting the wood with the sharpened splitting edge, the overall force required to split with the wedge-shaped anvil is reduced.

Figure 3:
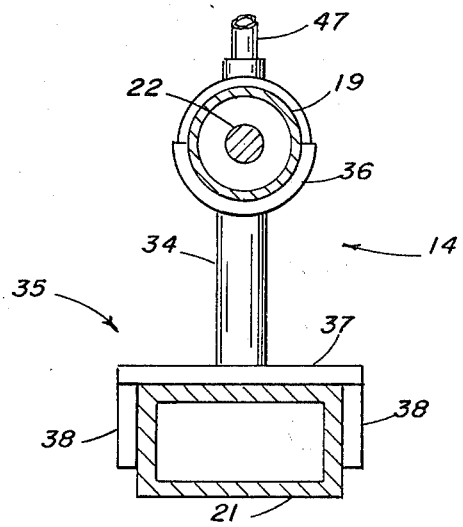
FIG. 3 is a transverse sectional view to an enlarged scale taken along the line 3—3 of FIG. 1, showing the construction of the hydraulic ram support; and, FIG. 4 is a fragmentary transverse sectional view to an enlarged scale taken along the line 4—4 of FIG. 1, showing the push plate structure and limit stop bar.

When the hydraulic ram 19 is lifted upwardly following removal of the pin 18, the hydraulic ram support 14 is placed between the ram 19 and the middle portion of the stabilizer leg 21, as can most clearly be seen in FIG. 1. The hydraulic ram support 14 comprises a vertical post 34, an upper arcuate trough 36, or cradle, shaped so as to accommodate the cylinder portion of the hydraulic ram 19, and a lower horizontal plate 37 having vertical plates 38 depending from its lateral extremes to form an inverted U-shaped channel 35. As shown in FIG. 3, the horizontal plate 37 and the depending vertical plates 38 form the U-shaped assemblage 35 capable of engaging the upper and lateral surfaces of the stabilizer leg 21. The hydraulic ram support 14 is held securely in position by the weight of the hydraulic ram 19.

The last step towards completing the assembly of the splitting apparatus 11 is the interconnection of the push plate assembly 16 and the hydraulic piston rod 22. Illustrated most clearly in FIG. 4, the push plate assembly 16 comprises a substantially square push plate 41, a pair of brackets 42, forming a clevis, and transverse limit stop 43 spanning the forward lower corner portions of the brackets 42.

The brackets 42 are parallel to each other and extend forwardly from the forward side of the push plate 41. A flanged pin 44 is inserted transversely through registering openings in the brackets 42, and through a journal bearing 45 mounted on the after end of the piston rod 22 and located between the brackets 42. The flanged pin 44 is secured with a cotter pin 46.

Figure 4:
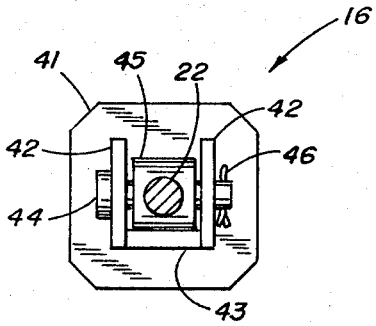

Since the push plate assembly 16 is capable of rotating about the horizontal transverse axis defined by the flanged pin 44, the limit stop 43 is interposed between the brackets 42 to limit such rotation. The limit stop 43, as previously stated, extends between the lower, forward corners of the brackets 42, as can be seen in FIGS. 2 and 4, and by interfering with the bottom of the piston rod 22 prevents excessive downward tilting of the push plate assembly during the time the push plate is not engaging a piece of wood.

In other words, referring to FIG. 1, the push plate assembly 16 has a gravitational tendency to rotate in a counter-clockwise fashion. The limit stop 43 impinges, however, upon the lower surface of ram rod 39 and thereby prevents any such rotation past a predetermined position. This position is generally limited to 20°–30° off the vertical, keeping the push plate 41 properly posed for conjunction with the forward end of a piece of wood 27 to be split.

The piece of wood 27 is first loaded upon the main support framework 13 as can be seen in FIGS. 1 and 2. The tractor or backhoe operator then actuates the proper hydraulic control for the hydraulic ram 19. As hydraulic fluid flows through hydraulic lines 47, the piston rod 22 translates rearwardly causing the push plate 41 to encounter the forward surface of wood 27. Owing to the rotational capacity of the push plate assembly 16, the push plate 41 is capable of cooperating to impress flushly upon the forward end of wood 27 despite some variation in slope of the end. This capacity to adopt to surface variations in the forward end of wood to be split substantially reduces point pressure on said push plate 41.

As the wood 27 is urged rearwardly into the knife edge 33, the splitting process begins according to the aforementioned description. The split pieces fall off the respective sides of the main support framework 13 and the operator again actuates the hydraulic control to cause the ram to retract the piston rod 22 and the push plate assembly 16 connected thereto. Another piece of wood is then loaded and the operation is repeated.

Normal usage of the stabilizer leg mechanism 12 is restored first by removal of the pin 18 and the flanged pin 44. Then, the support framework 13, the ram support 14 and the push plate assembly 16 are removed. The piston rod 22 and the stabilizer leg 21 are then reconnected by pin 20 and the stabilizer leg mechanism 12 is again capable of stabilizing the backhoe in conventional manner.

What is claimed is:

1. A wood splitter attachment for use with a backhoe or the like having a stabilizer and a stabilizer-positioning hydraulic ram normally pivotally interconnected by a ram to stabilizer pivot pin, said attachment comprising:

a. an elongated fore and aft framework;

b. means for attaching the forward end of said framework to the stabilizer after the stabilizer and the ram are disconnected by removal of the pivot pin, said attaching means being effective to position said framework and the stabilizer in fore and aft alignment;

c. a wedge-shaped wood splitting anvil mounted on the after portion of said framework with the tip of said wood splitting anvil directed towards the forward end of said framework;

d. a ram support extending vertically between the hydraulic ram and the stabilizer, said ram support comprising a vertical post, cradle means on the upper end of said vertical post for supporting the ram, and channel means on the lower end of said vertical post in engagement with the stabilizer enabling said ram support to be positioned at a selected fore and aft location on the stabilizer; and, e. a push plate pivotally mounted on the forward end of the ram plunger, said push plate being urgeable by the ram plunger against a piece of wood interposed between said push plate and said wedge-shaped anvil with a force sufficient to split the wood.

2. A device as in claim 1 wherein said means for attaching said framework to the stabilizer includes a transverse pin extending through a pivot aperture in the forward extremity of said framework and a registering opening in the stabilizer normally occupied by the ram to stabilizer pivot pin when the stabilizer and the ram are interconnected.

3. A device as in claim 2 further including a pair of lateral flanges mounted on said elongated framework, said flanges being located forwardly of said wedge-shaped anvil and extending laterally outwardly and upwardly from the upper edges of said elongated framework, said flanges cooperating with the upper surface of said elongated framework to support the wood being split.

4. A device as in claim 3 wherein the forward portion of said wedgeshaped anvil includes an elongated relatively narrow extension, said extension having vertical side walls generally parallel to the longitudinal axis of said elongated framework, and wherein said tip is knife-edged and is located at the forward end of said extension.

5. A device as in claim 1 further including an upright support stand, said support stand comprising a ground supported horizontal plate positioned beneath said elongated framework, an upright pedestal extending upwardly from said horizontal plate into supporting engagement with said elongated framework, said pedestal being of predetermined height in order to maintain said elongated framework in an attitude generally parallel to the ground.

6. A device as in claim 5 wherein said push plate is substantially vertical and includes a clevis mounted on the forward side of said push plate, a clevis pin transversely disposed in said clevis for pivotal engagement with the after end of the ram plunger, and a limit stop, said limit stop comprising a transverse bar interposed between the lower forward extremities of said clevis at an elevation below that of the after end of the ram plunger, said limit stop preventing said push plate from rotating about the clevis pivot beyond a predetermined position as said transverse bar abuts said hydraulic ram.

7. A device as in claim 6 wherein said cradle means includes a fore and aft trough capable of supporting the hydraulic ram, and said channel means includes an inverted U-shaped channel snugly supported on said stabilizer.

8. A device as in claim 7 wherein said vertical post is of predetermined height in order to maintain the hydraulic ram in an attitude generally parallel to said framework.

* * * * *